US005866881A

United States Patent [19]

Jones, III

[11] Patent Number: 5,866,881

[45] Date of Patent: Feb. 2, 1999

[54] MULTI-LAYER JACKET WITH CONVECTION HEATING MEANS

[76] Inventor: James D. Jones, III, 4047 Lugo Ave., Lynwood, Calif. 90262

[21] Appl. No.: 826,565

[22] Filed: Apr. 4, 1997

[51] Int. Cl.[6] ..... H05B 3/06

[52] U.S. Cl. ..... 219/527; 219/211; 219/530; 2/2.11; 2/2.14; 392/360

[58] Field of Search ..... 219/211, 212, 219/527–530, 535; 2/2.11, 2.14, 2.15, 2.16, 2.17; 392/360, 365, 374

[56] References Cited

U.S. PATENT DOCUMENTS

| | | | |
|---|---|---|---|
| 4,777,344 | 10/1988 | Nash | 219/529 |
| 4,798,933 | 1/1989 | Annovi | 219/211 |
| 5,049,724 | 9/1991 | Anderson | 219/212 |
| 5,404,652 | 4/1995 | Sher | 34/90 |
| 5,486,205 | 1/1996 | Cornell | 219/527 |

*Primary Examiner*—Teresa J. Walberg
*Assistant Examiner*—Quan Nguyen

[57] ABSTRACT

A multi-layer jacket with convection heating mechanism including a jacket having a pair of long sleeves and a front closeable opening. Also included is a heater coil adapted to produce heat upon the receipt of power. A convection fan is positioned adjacent the heat coil and is adapted to draw air from air inlet apertures of the jacket and further produce a heated air current upon the receipt of power. Further provided is a convection tube having a first end situated adjacent the heater coil opposite the convection fan for receiving the heated air current from the heater coil and convection fan. The convection tube is serpentinely situated throughout the jacket for distributing the heated air current throughout an interior of the jacket. Finally, a heater control mechanism is provided for allowing a user to control the amount of heat generated by the heater coil and the convection fan.

1 Claim, 3 Drawing Sheets

MULTI-LAYER JACKET WITH CONVECTION HEATING MEANS

BACKGROUND OF THE INVENTION

1. Field of the Invention

The present invention relates to a multi-layer jacket with convection heating means and more particularly pertains to efficiently distributing heat generated by a convection heater consistently throughout a jacket.

2. Description of the Prior Art

The use of heated jackets is known in the prior art. More specifically, heated jackets heretofore devised and utilized for the purpose of providing additional warmth to a user are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,696,066 to Ball et al.; U.S. Pat. No. 4,665,308 to Courvoiser; U.S. Pat. No. 4,273,989 to Hinton et al.; U.S. Pat. No. Des. 339,221 to Olajide; and U.S. Pat. No. 4,457,295 to Roehr; and U.S. Pat. No. 4,507,877 to Vaccari et al.

In this respect, the multi-layer jacket with convection heating means according to the present invention substantially departs from the conventional concepts and designs of the prior art, and in so doing provides an apparatus primarily developed for the purpose of efficiently distributing heat generated by a convection heater consistently throughout a jacket.

Therefore, it can be appreciated that there exists a continuing need for a new and improved multi-layer jacket with convection heating means which can be used for efficiently distributing heat generated by a convection heater consistently throughout a jacket. In this regard, the present invention substantially fulfills this need.

SUMMARY OF THE INVENTION

In view of the foregoing disadvantages inherent in the known types of heated jackets now present in the prior art, the present invention provides an improved multi-layer jacket with convection heating means. As such, the general purpose of the present invention, which will be described subsequently in greater detail, is to provide a new and improved multi-layer jacket with convection heating means which has all the advantages of the prior art and none of the disadvantages.

To attain this, the present invention essentially comprises a pair of long sleeves and a front closeable opening. As shown in FIGS. 1 & 8, the multi-layer jacket has an inner first layer comprising a thin cloth lining. Situated adjacent the first layer is an inner second layer comprising a heat conductive lining. The jacket further has an outer third layer situated adjacent the second layer and comprises an insulative lining. Finally, an outer fourth layer is situated adjacent the third layer and comprises a thin decorative cloth lining. The jacket further has a pocket located on the outer fourth layer on a front of the jacket. Further provided is a heater containment section positioned on a rear of the jacket adjacent a bottom edge thereof. The heater containment section includes a flap formed integral with the outer fourth layer and the outer third layer of the jacket. The flap has a pile fastener situated along a bottom edge thereof for releasably coupling with a second pile fastener situated along a bottom edge of the jacket. A plurality of air inlet apertures are linearly aligned along the bottom edge of the flap. In lieu of the first and second layers which are existent in the rest of the jacket, the heater containment section is equipped with an inner first layer comprising a thin cloth lining and an inner second layer situated adjacent the first layer that comprises an insulative lining. Next provided is a heater coil positioned within the heater containment compartment between the second layer and third layer thereof. Note FIG. 9. In use, the heater coil is adapted to produce heat upon the receipt of power. Further included is a convection fan positioned within the heater containment compartment between the second layer and third layer thereof adjacent the heat coil. The fan is adapted to draw air from the air inlet apertures of the jacket and further produce an air current upon the receipt of power. With reference to FIGS. 7 & 8, it can be seen that a convection tube is included. As shown in FIG. 9, the convection tube has a first end situated adjacent the heater coil opposite the convection fan for receiving a heated air current from the heater coil and convection fan. Further, the convection tube is serpentinely situated throughout the jacket between the second layer and third layer thereof for distributing the heated air current throughout an interior of the jacket. For controlling the heater coil and convection fan, heater control means includes a control housing having a rectangular configuration. To afford convenient access by a user, the control housing is situated within the pocket of the jacket. Located within the control housing is a plurality of various electrical components including a 555 timer adapted to transmit a series of pulses with a predetermined frequency upon the receipt of power. Note FIG. 6. Associated therewith is a one-shot multivibrator connected to the 555 timer and adapted to produce an activation signal with the predetermined frequency and a duty cycle. Such duty cycle is controlled by a potentiometer associated with the one-shot multivibrator. A voltage controlled switch is connected between the one-shot multivibrator and the heater coil for actuating the heater coil only upon the receipt of a high pulse of the activation signal. Lastly, a power switch is situated on an exterior of the control housing and is electrically connected between a rechargeable battery, the 555 timer, the voltage controlled switch, and the convection fan. In operation, the power switch has a first orientation for supplying power to the rechargeable battery, the 555 timer, the voltage controlled switch, and the convection fan and a second orientation for precluding the supply of power thereto. As shown in FIG. 2, the control housing further includes a dial situated on the exterior of the control housing for allowing a user to adjust the potentiometer. By this structure, a user is permitted to control the amount of heat generated by the heater coil and the convection fan. Finally, for charging a rechargeable battery that is relied upon for power purposes, a charging circuit is provided. See FIG. 5. Such charging circuit includes a transformer with a primary portion connected to a conventional alternating current receptacle and a secondary portion center tapped with the primary side. By this design, the voltage received from the alternating current receptacle is stepped down. Connected to the transformer is a bridge rectifier for rectifying the alternating current. An RC circuit is connected to the bridge rectifier for converting the rectified alternating current to direct current. Lastly, a transistor is connected between the RC circuit and the rechargeable battery for allowing the charging thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-layer jacket with convection heating means which has all the advantages of the prior art heated jackets and none of the disadvantages.

It is another object of the present invention to provide a new and improved multi-layer jacket with convection heating means which may be easily and efficiently manufactured and marketed.

It is a further object of the present invention to provide a new and improved multi-layer jacket with convection heating means which is of a durable and reliable construction.

An even further object of the present invention is to provide a new and improved multi-layer jacket with convection heating means which is susceptible of a low cost of manufacture with regard to both materials and labor, and which accordingly is then susceptible of low prices of sale to the consuming public, thereby making such multi-layer jacket with convection heating means economically available to the buying public.

Still yet another object of the present invention is to provide a new and improved multi-layer jacket with convection heating means which provides in the apparatuses and methods of the prior art some of the advantages thereof, while simultaneously overcoming some of the disadvantages normally associated therewith.

Still another object of the present invention is to efficiently distribute heat generated by a convection heater consistently throughout a jacket.

Lastly, it is an object of the present invention to provide a new and improved multi-layer jacket with convection heating means including a jacket having a pair of long sleeves and a front closeable opening. Also included is a heater coil adapted to produce heat upon the receipt of power. A convection fan is positioned adjacent the heat coil and is adapted to draw air from air inlet apertures of the jacket and further produce a heated air current upon the receipt of power. Further provided is a convection tube having a first end situated adjacent the heater coil opposite the convection fan for receiving the heated air current from the heater coil and convection fan. The convection tube is serpentinely situated throughout the jacket for distributing the heated air current throughout an interior of the jacket. Finally, a heater control mechanism is provided for allowing a user to control the amount of heat generated by the heater coil and the convection fan.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
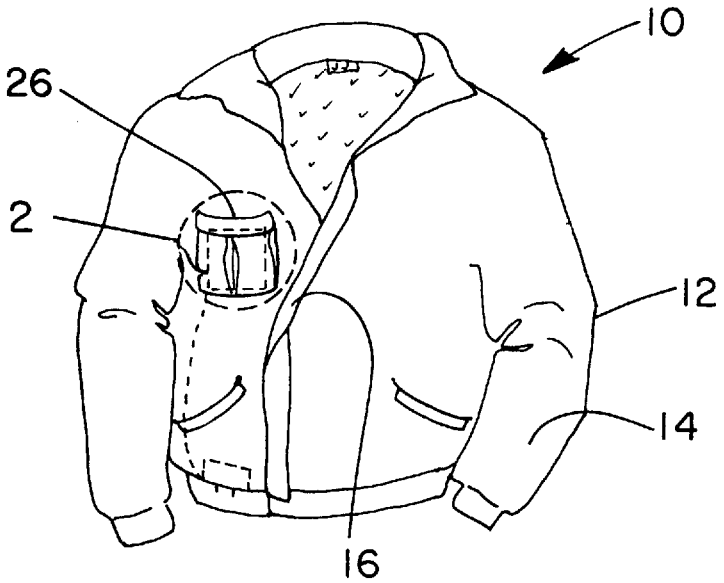
FIG. 1 is a perspective illustration of the preferred embodiment of the multi-layer jacket with convection heating means constructed in accordance with the principles of the present invention.

With reference now to the drawings, and in particular to FIG. 1 thereof, a new and improved multi-layer jacket with convection heating means embodying the principles and concepts of the present invention and generally designated by the reference numeral 10 will be described.

The present invention, the new and improved multi-layer jacket with convection heating means, is comprised of a plurality of components. Such components in their broadest context include a multi-layer jacket, heater coil, convection fan, heater control means, and a recharger circuit. Such components are individually configured and correlated with respect to each other so as to attain the desired objective.

Figure 8:
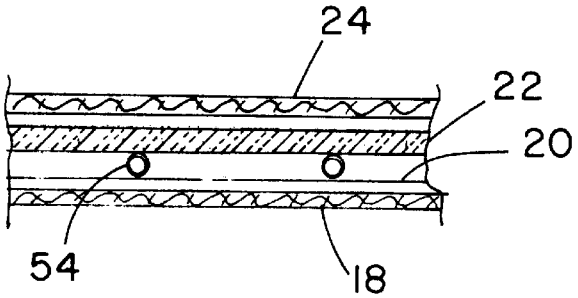
FIG. 8 is a cross-sectional view of the jacket illustrating the various layers of the preferred embodiment of the present invention.

More specifically, it will be noted that the system 10 of the present invention includes a multi-layer jacket 12 having a pair of long sleeves 14 and a front closeable opening 16. As shown in FIGS. 1 & 8, the multi-layer jacket has an inner first layer 18 comprising a thin cloth lining. Situated adjacent the first layer is an inner second layer 20 comprising a heat conductive lining. Such heat conductive lining is preferably composed of a flexible thin metallic material such as aluminum foil. The jacket further has an outer third layer 22 situated adjacent the second layer comprising an insulative lining. The insulative lining has a thickness twice that of the inner first layer. Ideally, such material is of a denser fabric such as wool or the like. Finally, an outer fourth layer 24 is situated adjacent the third layer and comprises a thin decorative cloth lining. The jacket further has a pocket 26 located on the outer fourth layer on a front of the jacket.

Further provided is a heater containment section 28 positioned on a rear of the jacket adjacent a bottom edge thereof. The heater containment section includes a flap 30 formed integral with the outer fourth layer and the outer third layer of the jacket. Such flap is basically an extension of the fourth and third layers of the jacket that are free to be raised for gaining access therebeneath. The flap has a pile fastener 32 situated along a bottom edge thereof for releasably coupling with a second pile fastener 34 situated along a bottom edge of the jacket. A plurality of air inlet apertures 36 are linearly aligned along the bottom edge of the flap. In lieu of the first and second layers which are existent in the rest of the jacket, the heater containment section is equipped with an inner first layer comprising a thin cloth lining and an inner second layer situated adjacent the first layer that comprises an insulative lining.

Figure 9:
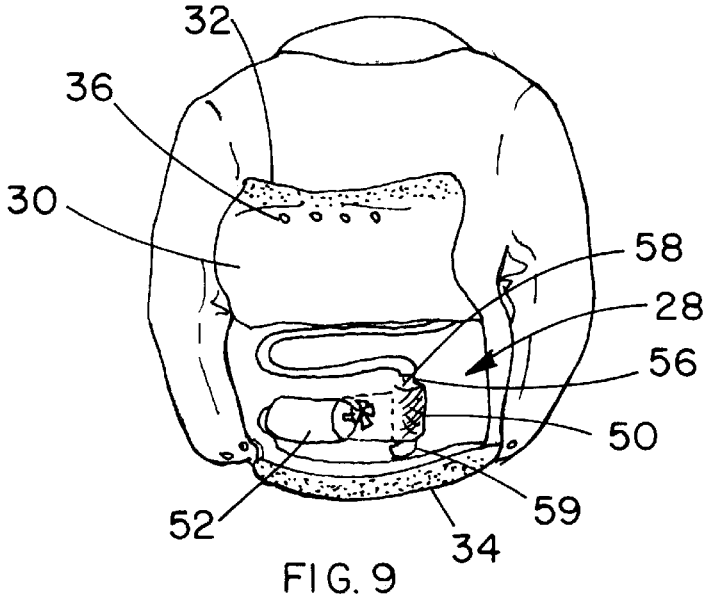
FIG. 9 is a rear view of the jacket of the preferred embodiment of the present invention and the heater containment compartment thereof.

Next provided is a heater coil 50 coupled within the heater containment compartment between the second layer and third layer thereof. Note FIG. 9. In use, the heater coil is adapted to produce heat upon the receipt of power. As shown in FIG. 9, the heater coil has a hollow cylindrical configuration with an aperture located on opposite ends thereof and further an access opening on a side thereof.

Further included is a convection fan 52 positioned within the heater containment compartment between the second layer and third layer thereof adjacent the heat coil. The fan is adapted to draw air from the air inlet apertures of the jacket and further produce a heated air current upon the receipt of power. To accomplish this, the convection fan is connected to the access opening of the heater coil for directing the air current therein.

Figure 7:
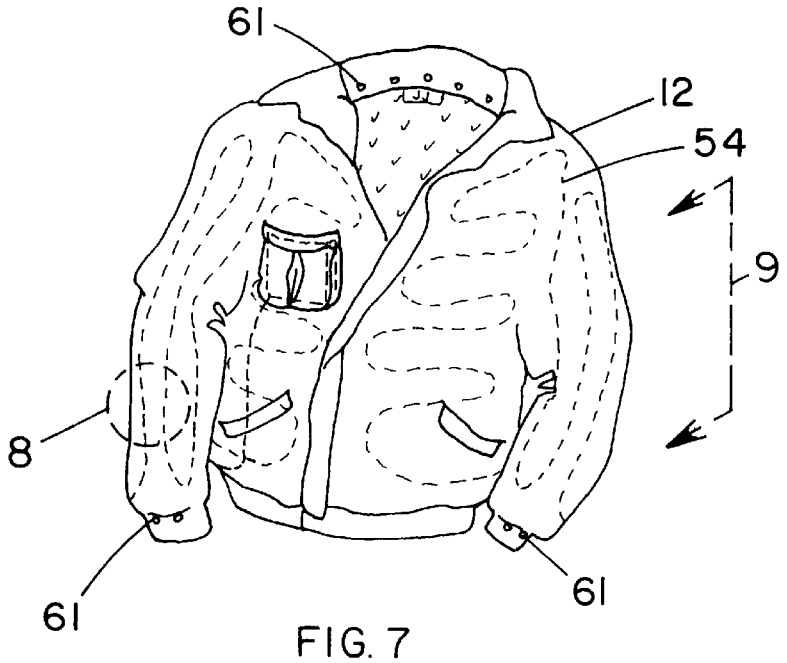
FIG. 7 is a front view of the multi-layer jacket depicting the orientation of the convection tube of the preferred embodiment.

With reference to FIGS. 7 & 8, it can be seen that a convection tube 54 is included. As shown in FIG. 9, the convection tube has a first end 56 connected to one of the apertures 58 of the heater coil for receiving a heated air current from the heater coil and convection fan. Further, the convection tube is serpentinely situated throughout the jacket between the second layer and third layer thereof for distributing the heated air current throughout an interior of the jacket. Uniform distribution of the heat radiated from the tube is facilitated by means of the conductive layer. To recycle the heated air current, a second end of the tube is situated adjacent the other aperture 59 of the heater coil. In the alternative, the tube may terminate in a plurality of open second ends 61 situated within collar and cuffs of the jacket. Note FIGS. 1 & 7. By such placement, exhaust heated air may be employed to heat the head and hands of a user. In both embodiments, the aperture 59 may be equipped with a one-way valve so that the heated air current is directed in the proper direction.

Figure 2:
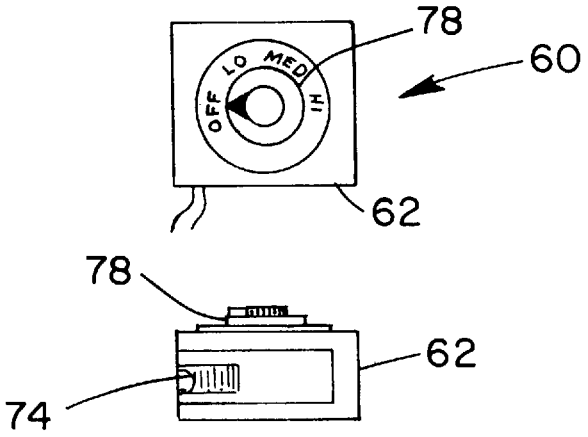
FIG. 2 is a top and side view of the control housing of the present invention.
Figure 6:
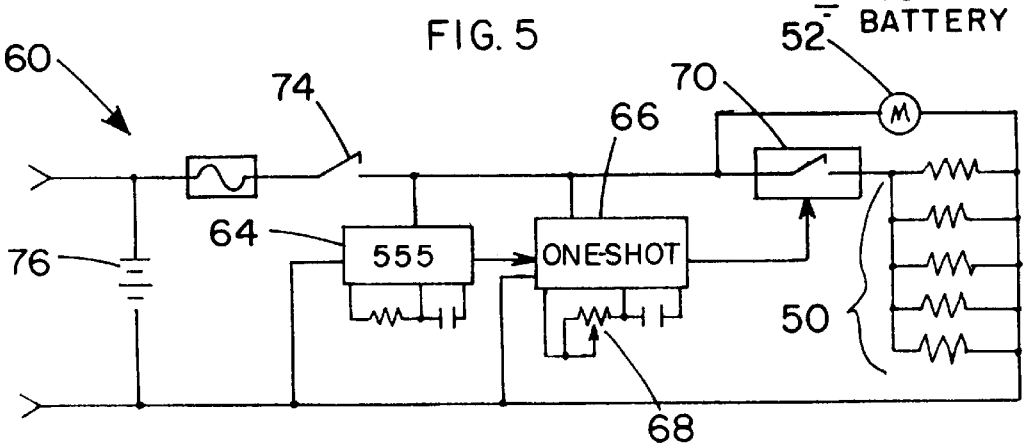
FIG. 6 is a schematic diagram illustrating the various electrical components of the heater control means.

For controlling the heater coil and convection fan, heater control means 60 includes a control housing 62 having a rectangular configuration. To afford convenient access by a user, the control housing is situated within the pocket of the jacket. Located within the control housing is a plurality of various electrical components including a 555 timer 64 adapted to transmit a series of pulses with a predetermined frequency upon the receipt of power. Note FIG. 6. The 555 timer ideally pulses once every two seconds (0.5 HZ). Associated therewith is a one-shot multivibrator 66 adapted to produce an activation signal with the predetermined frequency and a duty cycle. Such duty cycle is controlled by a potentiometer 68 associated with the one-shot multivibrator. A voltage controlled switch 70 is connected between the one-shot multivibrator and the heater coil for actuating the heater coil only upon the receipt of a high pulse of the activation signal. Preferably, the voltage controlled switch takes the form of a MOSFET, relay, or the like. Lastly, a power switch 74 is situated on an exterior of the control housing and is electrically connected between a rechargeable battery 76, the 555 timer, the voltage controlled switch, and the convection fan. In operation, the power switch has a first orientation for supplying power to the rechargeable battery, the 555 timer, the voltage controlled switch, and the convection fan and a second orientation for precluding the supply of power thereto. As shown in FIG. 2, the control housing further includes a dial 78 situated on the exterior of the control housing for allowing a user to adjust the potentiometer. By this structure, a user is permitted to control the amount of heat generated by the heater coil and the convection fan. It should be noted that the fan constantly remains activated while the power switch is in the first orientation thereof.

Figure 5:
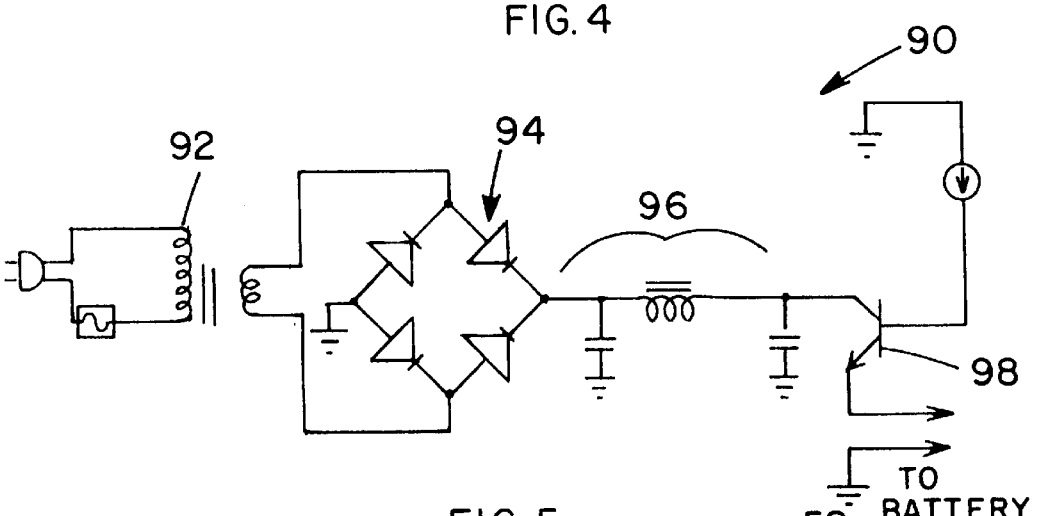
FIG. 5 is a schematic diagram showing the various electrical components associated with the recharging circuit of the present invention.

Finally, for charging the rechargeable battery, a charging circuit 90 is provided. See FIG. 5. Such charging circuit includes a transformer 92 with a primary portion connected to a conventional alternating current receptacle and a secondary portion center tapped with the primary side. By this design, the voltage received from the alternating current receptacle is stepped down. Connected to the transformer is a bridge rectifier 94 for rectifying the alternating current. An RC circuit 96 is connected to the bridge rectifier for converting the rectified alternating current to direct current. Lastly, a transistor 98 is connected between the RC circuit and the rechargeable battery for allowing the charging thereof. Preferably, a recharging current of approximately 100 mA is afforded. Depending on the preference of the user, the charging circuit may or may not be situated within the jacket.

Figure 3:
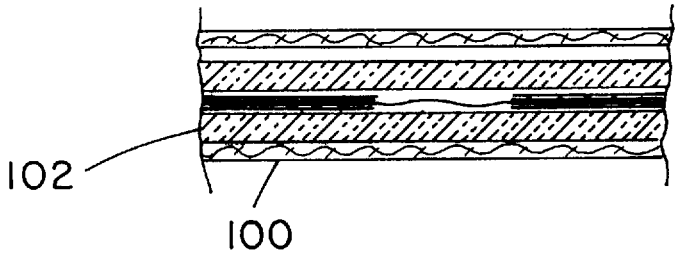
FIG. 3 is a cross-sectional view of a jacket of an alternate embodiment.
Figure 4:
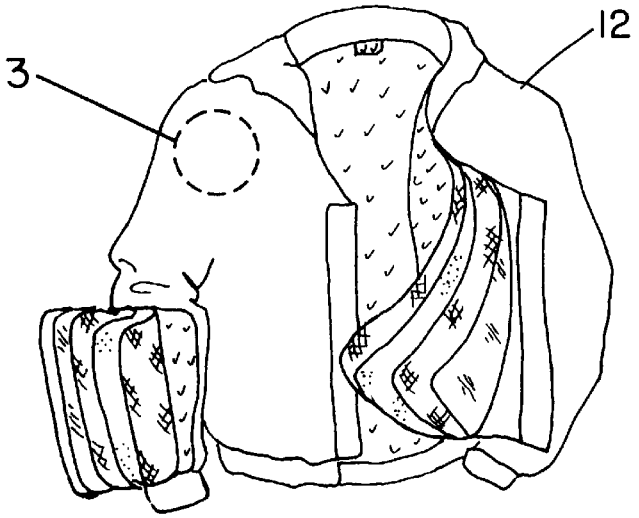
FIG. 4 is an exploded view depicting the various layers of the multi-layer jacket of FIG. 3.

As shown in FIGS. 3 and 4, an alternate embodiment is included wherein the second heat conductive layer is replaced by an insulative layer. Further, the resistive heating coil itself is serpentinely situated throughout the jacket between the second and third layer. The second layer thus prevents the user from being directly subjected to the intense heat generated by the heating coil.

In yet an another embodiment, the air inlet and exhaust apertures are removed and the heat convection tube is coupled at opposite ends to the heating coil in a closed-loop configuration. By this structure, a liquid may be driven to flow throughout the tubes by means of a pump.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-layer jacket with convection heating means comprising, in combination:

a multi-layer jacket having a pair of long sleeves and a front closeable opening, the multi-layer jacket having an inner first layer comprising a thin cloth lining, an inner second layer situated adjacent the first layer and comprising a heat conductive lining, a dense outer third layer situated adjacent the second layer and comprising an insulative lining having a thickness twice that of the inner first layer, and an outer fourth layer situated adjacent the third layer and comprising a thin decorative cloth lining, the jacket further comprising a pocket located on the outer fourth layer on a front of the jacket and a heater containment section positioned on a rear of the jacket adjacent a bottom edge thereof, the heater containment section including a flap formed integral with the outer fourth layer and the outer third layer of the jacket, the flap having a pile fastener situated along a bottom edge thereof for releasably coupling with a second pile fastener situated along a bottom edge of the jacket and a plurality of air inlet apertures linearly aligned along the bottom edge of the flap, the heater containment section further having an inner first layer comprising a thin cloth lining and an inner second layer situated adjacent the first layer and comprising an insulative lining;

a heater coil positioned within the heater containment compartment between the second layer and third layer thereof, the heater coil adapted to produce heat upon the receipt of power, wherein the heater coil has a hollow cylindrical configuration with apertures located on opposite ends thereof and further an access opening on a side thereof;

a convection fan positioned within the heater containment compartment between the second layer and third layer thereof adjacent the heat coil, the fan adapted to draw air from the air inlet apertures of the jacket and further produce an air current upon the receipt of power and direct the same into the access opening of the heater coil;

a convection tube having a first end situated adjacent one of the apertures of the heater coil for receiving a heated air current from the heater coil and convection fan, the convection tube serpentinely situated throughout the jacket between the second layer and third layer thereof for distributing the heated air current throughout an interior of the jacket, wherein the convection tube has a plurality of additional ends in communication with apertures formed in a collar and cuffs of the jacket;

heater control means including a control housing having a rectangular configuration and being situated within the pocket of the jacket, the heater control means further including a 555 timer adapted to transmit a series of pulses with a predetermined frequency upon the receipt of power, a one-shot multivibrator connected to the 555 timer and adapted to produce an activation signal with the predetermined frequency and a duty cycle controlled by a potentiometer connected thereto, a voltage controlled switch connected between the one-shot multivibrator and the heater coil for actuating the heater coil only upon the receipt of a high pulse of the activation signal, and a power switch situated on an exterior of the control housing and electrically connected between a rechargeable battery, the 555 timer, the voltage controlled switch, and the convection fan, the power switch having a first orientation for supplying power to the rechargeable battery, the 555 timer, the voltage controlled switch, and the convection fan and a second orientation for precluding the supply of power thereto, the heater control means further including a dial situated on the exterior of the control housing for allowing a user to adjust the potentiometer thereby controlling the amount of heat generated by the heater coil; and a charging circuit including a transformer with a primary portion connected to a conventional alternating current receptacle and a secondary portion center tapped with the primary side thereby stepping down the voltage received from the current receptacle, a bridge rectifier connected to the transformer for rectifying the alternating current, an RC circuit connected to the bridge rectifier for converting the rectified alternating current to direct current, and a transistor connected between the RC circuit and the rechargeable battery for allowing the charging thereof.

* * * * *